US006855002B2

(12) United States Patent
Chiu

(10) Patent No.: US 6,855,002 B2
(45) Date of Patent: Feb. 15, 2005

(54) FLAT FLEXIBLE CIRCUIT BOARD CONNECTOR

(75) Inventor: Hsien-Yu Chiu, Taoyuan (TW)

(73) Assignee: P-Two Industries, Inc., Taoyuan (TW)

( * ) Notice: Subject to any disclaimer, the term of this patent is extended or adjusted under 35 U.S.C. 154(b) by 0 days.

(21) Appl. No.: 10/660,497

(22) Filed: Sep. 12, 2003

(65) Prior Publication Data

US 2004/0235341 A1 Nov. 25, 2004

(30) Foreign Application Priority Data

May 20, 2003 (TW) ..... 92209160 U

(51) Int. Cl.[7] ..... H01R 9/07
(52) U.S. Cl. ..... 439/495; 439/67
(58) Field of Search ..... 439/495, 492, 439/493, 496, 260, 259, 67, 630, 629

(56) References Cited

U.S. PATENT DOCUMENTS 4,936,792 A * 6/1990 Onoue et al. ..... 439/329
5,173,058 A * 12/1992 Broeksteeg et al. ..... 439/267
5,839,917 A * 11/1998 Takahashi et al. ..... 439/495
5,842,883 A * 12/1998 Igarashi et al. ..... 439/495
6,352,442 B1 * 3/2002 Kudo ..... 439/260
6,551,128 B2 * 4/2003 Asai ..... 439/495
6,669,503 B2 * 12/2003 Hirose ..... 439/495

* cited by examiner

*Primary Examiner*—Hien Vu
(74) *Attorney, Agent, or Firm*—Troxell Law Office PLLC

(57) ABSTRACT

An ultra-thin flat flexible circuit board connector includes a movable lid capable of lifting and overturning as an upper side wall of the flexible circuit board connector. Positions of the movable lid having been lifted and overturned are an at an opposite direction to that of the flexible circuit board to be inserted, and thus leaving insertion operations of the flexible circuit board entirely unaffected. A breadth of the lifting and overturning movable lid has a plurality of terminal grooves. When the movable lid is closed, terminals of the flexible circuit board are partially exposed in the terminal grooves at the movable lid, thereby effectively reducing thickness of the flexible circuit board connector for forming an ultra-thin flexible circuit board connector.

4 Claims, 8 Drawing Sheets

FLAT FLEXIBLE CIRCUIT BOARD CONNECTOR

BACKGROUND OF THE INVENTION (a) Field of the Invention

The invention relates to a flat flexible circuit board connector, and more particularly, to a flexible circuit board connector having an upper side wall as a movable lid capable of lifting and overturning, while lifted and overturned positions of the movable lid leaving insertions of the flexible circuit board unaffected.

(b) Description of the Prior Art

Referring to FIGS. 1 to 3 showing a structure and operations of a prior flexible circuit board 10, the flexible circuit board 10 comprises a lengthy longitudinal insulation body 20 and a U-shaped movable lid 30. Inserting terminals 25 are placed in an interior of the insulation body 20. The movable lid 30 has left and right projecting flanges 32 for pivotally connecting side walls 24 at two sides of the insulation body 20. The movable lid 30 is allowed with a certain distance for withdrawal and a certain angle for rotation, so as to enable a flexible circuit board 90 to insert into an embedding slot in the insulation body 20, and to further electrically connect the flexible circuit board 90 with the inserting terminals 25 in the insulation body 20. Thus, the movable lid 30 is joined and positioned with the insulation body 20, and the flexible circuit board 90 is steadily fastened in the embedding slot in the insulation body 20.

However, the insulation body 20 has a sealed structure consisted of upper and lower side walls, and left and right side walls, with the inserting terminals 25 enclosed therein. This structure naturally prohibits the movable lid 30 to become a part of the upper side wall of the insulation body 20. As a result, pivotal fulcrums for lifting and overturning, or closing the movable lid 30 cannot be disposed at a rear portion of the insulation body 20. Instead, the pivotal fulcrums are necessarily provided at the two side walls of the insulation body 20, and thus the movable lid 30 is only capable of lifting and overturning, or covering in a U shape. Referring to FIG. 2, an angle for lifting and rotation is limited. Especially when the movable lid 30 displays a beveled position after having been withdrawn and lifted, the movable lid 30 is approximately above a front portion of the embedding slot of the insulation body 20. At this point, alignment of the flexible circuit board 90 with the embedding slot of the insulation body 20 is somewhat hindered, and insertion of the flexible circuit board 90 is often obstructed.

Therefore, the invention provides an advanced and complete structure of a flexible circuit board connector, which not only facilitates insertion and embedding of flexible circuit boards but also effectively reduces thickness of flexible circuit boards

SUMMARY OF THE INVENTION

The primary object of the invention is to provide an ultra-thin and flat flexible circuit board connector, wherein an upper side wall of the flexible circuit board connector is formed by a movable lid capable of lifting and overturning. More particularly, positions of the movable lid having been lifted and overturned are at an opposite direction to that of a flexible circuit board to be inserted, thereby leaving insertion of the flexible circuit board entirely unaffected.

The secondary object of the invention is to provide an ultra-thin and flat flexible circuit board connector, wherein the lifting and overturning movable lid has terminal grooves.

When the movable lid is closed, the terminals of the flexible circuit board connector are partially exposed in the terminal grooves of the movable lid, thereby reducing thickness of the flexible circuit board connector for forming an ultra-thin flexible circuit board connector.

The other object of the invention is to provide an ultra-thin and flat flexible circuit board connector, wherein a rear end face of the lifting and overturning movable lid is formed as a downwardly tilted structure, so that ends of the terminal grooves are formed as protruding axes having ellipsoidal cross sections. Each protruding axis forms a set of protruding mechanism with a terminal having a specific shape. When the movable lid is closed, displacement of ellipsoidal circumscriptions of the protruding axes compels front portions of the terminals to press downward.

DETAILED DESCRIPTION OF THE PREFERRED EMBODIMENTS

To better understand the invention, detailed descriptions shall be given with the accompanying drawings hereunder.

Figure 5:
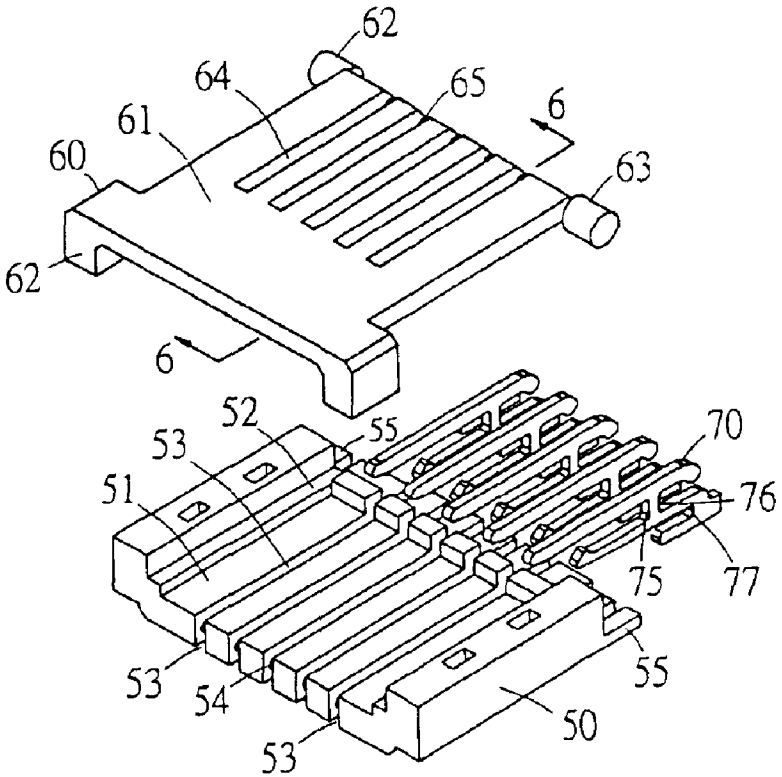
FIG. 5 shows an exploded view of the flat flexible circuit board according to the invention.
Figure 4:
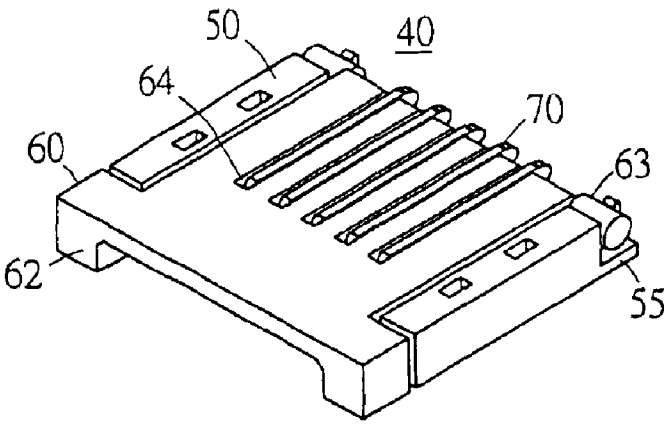
FIG. 4 shows an elevational schematic view of the flat flexible circuit board according to the invention.
Figure 6:
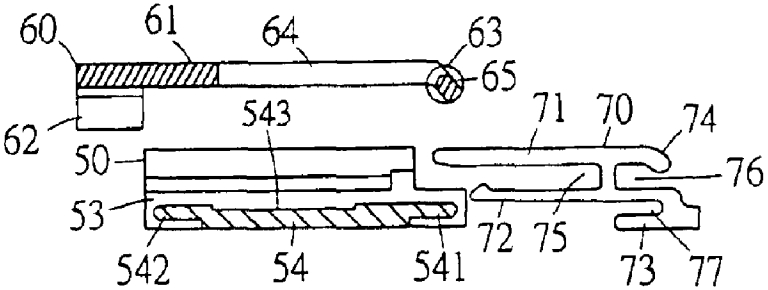
FIG. 6 shows a sectional view of FIG. 5 along 6—6.

Referring to FIGS. 4 to 6, a flexible circuit board connector 40 according to the invention comprises a concave body 50, a movable lid 60, and a plurality of terminals 70 embedded at the concave body 60. When the movable lid 60 is closed, it forms a cover of the concave body 50, and the terminals 70 are exposed in terminal grooves 64 at the movable lid 60, such that thickness of the flexible circuit board connector 40 is substantially reduced, and hence forming an ultra-thin flexible circuit board connector 40.

Figure 9:
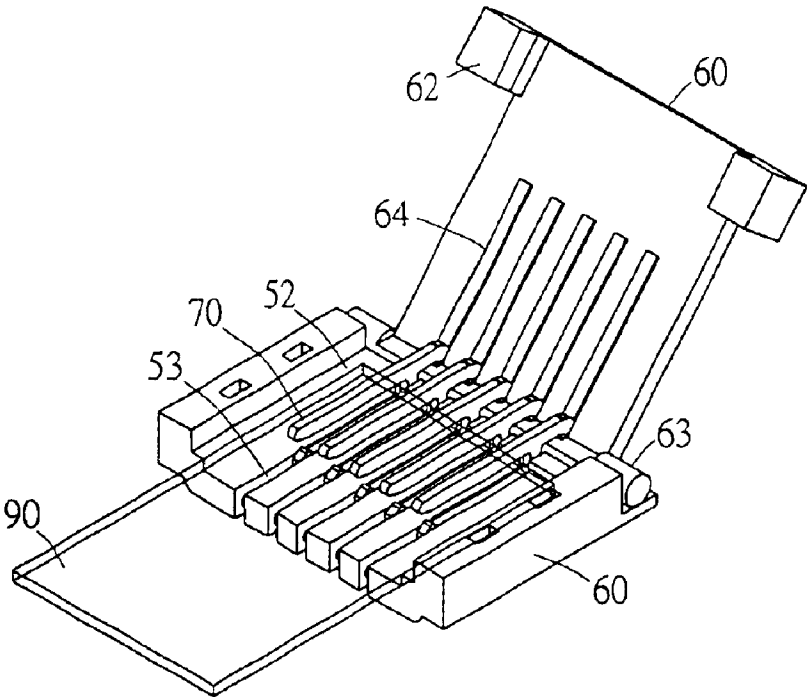
FIG. 9 shows a schematic view illustrating the movable lid 60 of the flat flexible circuit board connector being lifted for insertion of the flexible circuit board 90 according to the invention.

The concave body 50 has an open space facing downward for forming a base of 51 of the concave body 50. Positions at two sides of the base 51 and adjacent to the side wall of the base 51 are extended upward with a certain height, so as to form left and right side flanges 52 for displaying the open space of the base 51 as a double-tiered open space. The upper-tier open space is wider than the lower-tier open space. That is, an open space above the side flanges 52 forms the upper-tier open space of the base 51 with a width of the open space measured as a distance between the left and right side walls; and an open space surrounded by sides of the side flanges 52 forms the lower-tier open space of the base 51 with a width of the open space measure as a distance between the side flanges 52. Referring to FIGS. 4 to 7, the upper-tier open space of the base 51 provides a space for covering the movable lid 60. Hence, when the movable lid 60 forms a lid of the concave body 50 while closed, the lower-tier open space at the base 51 serves as a space for inserting the flexible circuit board 90 as shown in FIG. 9, so as to electrically connect the flexible circuit board 90 with the terminals 70.

Figure 11:
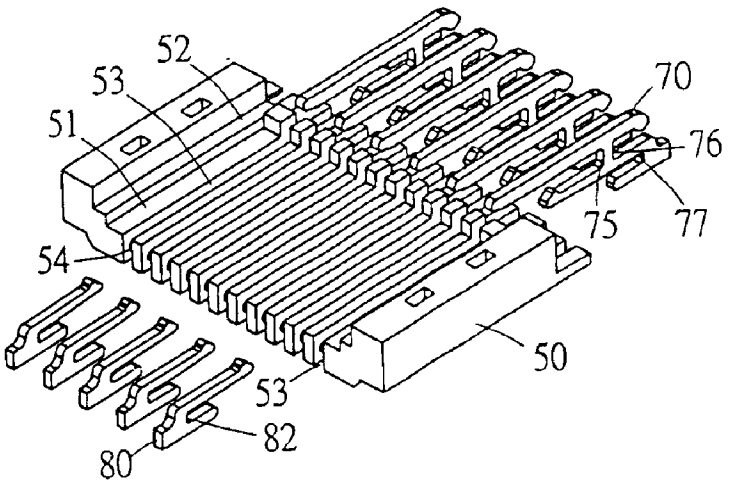
FIGS. 11 and 12 show schematic views illustrating the concave body 50 providing two sets of different terminals with staggered arrangements in the channels 53 according to the invention.
Figure 10:
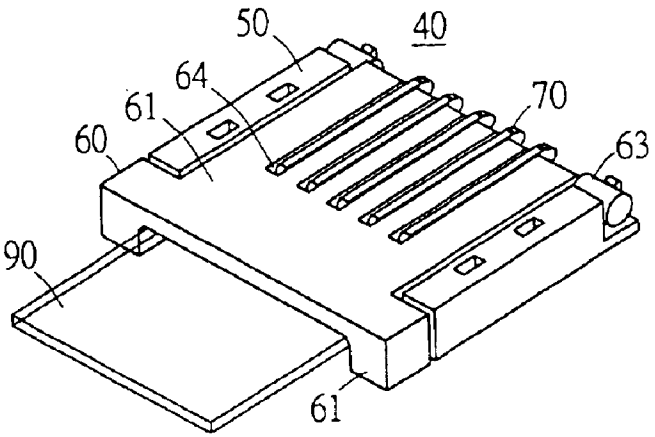
FIG. 10 shows a schematic view illustrating the movable lid 60 of the flat flexible circuit board connector being closed after having inserted and fastened the flexible circuit board 90 therein.
Figure 12:
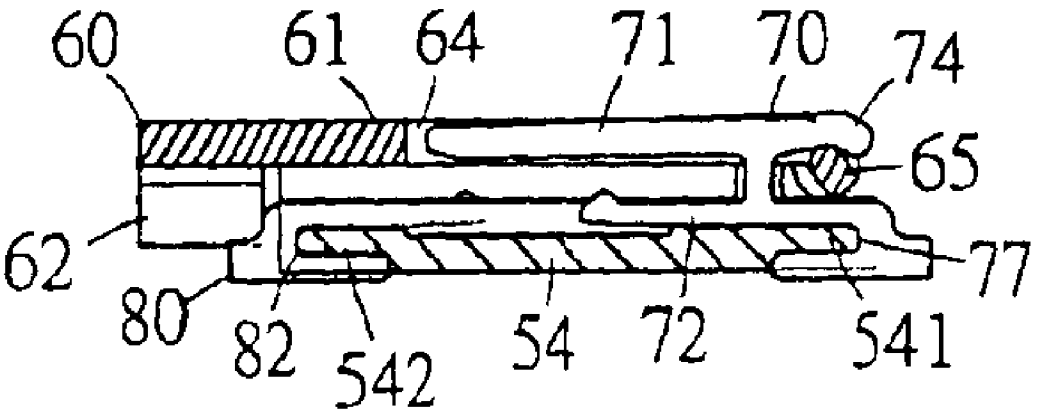

The base 51 of the concave body 50 has a plurality of channels 53. Each channel 53 is formed with an embedding rib 54 having a sectional shape as shown in FIG. 6. To be more accurate, referring to FIG. 6, a top portion of the embedding rib 54 is sunken as a recess 543 having a certain height, whereas front and end portions of the embedding rib 54 are extended with tongues for forming a rear portion 541 and a front portion 542. The above structure provides the concave body 50 with multiple functions. Referring to FIGS. 11 and 12, the rear portion 541 and the front portion 542 enable a set of terminals 70 and another set of terminals 80 having a different style to be simultaneously inserted into the channels 53 of the concave body 50 in a staggered manner. Therefore, according to the above usage, suppose the concave body 50 provides insertion of only one set of terminals 70 into the channels 54; that is, the structure has only the rear portion 541 but not the front portion 542; another embodiment of a concave body 50 having a different structure is formed. In addition, the concave body 50 has a receiving surface 55 extended from rear sides thereof, respectively, so as to form fulcrums for lifting and closing the movable lid 60 by placing the pivotal axes 63 of the movable lid 60 thereon.

Referring to FIGS. 5 and 6, each terminal 70 has an upper pin 71, a lower pin 72 and an embedding pin 73, with an inserting gap 75, a pivotal gap 76 and a bottom gap 77 formed in between. Referring to FIGS. 11 and 12, a terminal 80 shown has similar structures for the lower pin 72 and the embedding pin 73 of the terminal 70, and thus shall not be unnecessarily described.

The embedding pin 73 is connected to a rear end of the lower pin 72, and forms the bottom gap 77 in coordination with a distance between a front end thereof and a rear end of the lower pin 72. Through dovetailing of the rear portion 541 at the embedding rib 54 of the concave body 50 to the cog bottom gap 77 of the terminal 70, the terminal 70 is steadily fastened in the channel 53 of the concave body 50.

Figure 7:
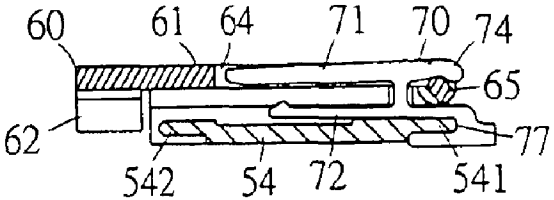
FIG. 7 shows a sectional view illustrating the movable lid 60 of the flat flexible circuit board connector being closed according to the invention.
Figure 8:
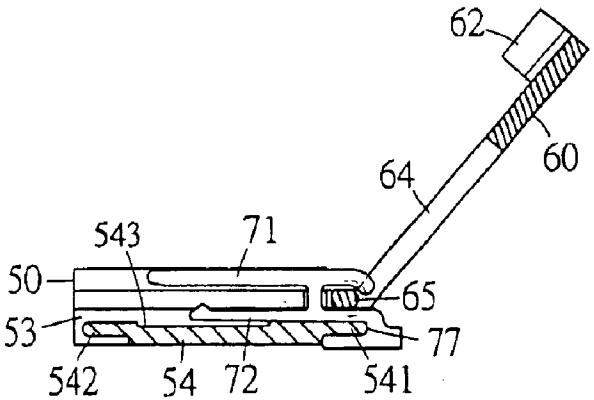
FIG. 8 shows a sectional view illustrating the movable lid 60 of the flat flexible circuit board connector being lifted to a maximum angle thereof according to the invention.

The upper pin 71 and the lower pin 72 form an integral by joining with a plate 78. A distance between a front end of the upper pin 71 and a front end of the lower pin 72 forms the inserting gap 75. When the terminal 70 is fastened in the channel 53 at the concave body 50, referring to FIGS. 7 to 9, a position of the inserting gap 75 of the terminal 70 is exactly located at the lower-tier open space at the base 51 of the concave body 50, whereas the upper pin 71 of the terminal 70 is located at the upper-tier open space at the base 51 of the concave body 50. Therefore, as shown in FIG. 9, the inserting gap 75 of the terminal 70 serves as an space for inserting the flexible circuit board 90, so as to electrically connect the flexible circuit board 90 with the upper pin 71 and the lower pin 72, and hence electrically connecting the flexible circuit board 90 with the terminal 70. Referring to FIGS. 7 and 8, the front end of the lower pin 72 is exactly suspended above the recess 543 at the top portion of the embedding rib 54 of the concave body 50. Consequently, the front end of the lower pin 72 forms a cantilever structure having flexibility to a certain extent, thereby facilitating insertion of the flexible circuit board 90 into the inserting gap 75 of the terminal 70.

A distance between a rear end of the upper pin 71 and a rear end of the lower pin 72 forms a pivotal gap 76. In addition, the rear end of the upper pin 71 is bent downward for forming the bent portion 74. Hence, an opening of the pivotal gap 76 is relatively narrower for offering fastening effects.

The movable lid 60 is provided with a board 61 having a projecting pivotal axis 63 at left and right sides of a rear end thereof, respectively. Referring to FIGS. 8 and 9, when the pivotal axes 63 are placed on the receiving surfaces 55 at the rear sides of the concave body 50, the pivotal axes 63 function as fulcrums for lifting and closing the movable lid 60. The board 61 further has a blocking piece 62 extended from two sides of a front end thereof, respectively. The blocking pieces 62 assist a user to apply force and act as points of application of force for lifting and closing the movable lid 60. More particularly, distances between the pivotal axes 63 functioning as fulcrums and the blocking pieces 62 acting as points of application of force are designed as maximum leverage for application of force, thereby effortlessly lifting and closing the movable lid 60.

Referring to FIG. 6, a rear end face of the board 61 of the movable lid 60 is a structure tilting downward. A purpose of the downwardly tilting structure is for limiting a maximum angle of lifting the movable lid 60 as indicated in FIG. 8. Also, at positions corresponding to the channels 53, a breadth of the board 61 is disposed with a plurality of terminal grooves 64. Each terminal groove 64 has a rear end thereof formed as a protruding axis 65 having an ellipsoidal cross section using the tilted structure at the rear end face of the board 61. Hence, through thinner parts of the ellipsoidal cross section of the protruding axis 65, the protruding axis 65 of the movable lid 60 is pressed into an interior of the pivotal gap 76 of the terminal 70. A long and narrow shape of an opening of the pivotal gap 76 is then utilized such that the protruding axis 65 is unlikely to depart from the interior of the pivotal gap 76. Referring to FIG. 8, at this point, the movable lid 60 is pivotally joined with the terminal 70 securely fastened within the channel 53 of the concave body 50, and is also leaned against the receiving surfaces 55 at the rear sides of the concave body 60. Referring to FIGS. 7 and 8, when the movable lid 60 rotates regarding the pivotal axes 63 as fulcrums thereof, each protruding axis 65 forms a set of protruding axis mechanism with the upper pin 71 of the terminal 70. Especially when the movable lid 60 is being closed, displacement of the ellipsoidal cross section of the protruding axis 65 forces the protruding axis 65 against the bent portion 74 at the upper pin 71 of the terminal 70. Due to leverage effects, the upper pin 71 of the terminal 70 uses the plate 78 as a fulcrum thereof to press a front portion of the upper pin 71 downward.

Figure 1:
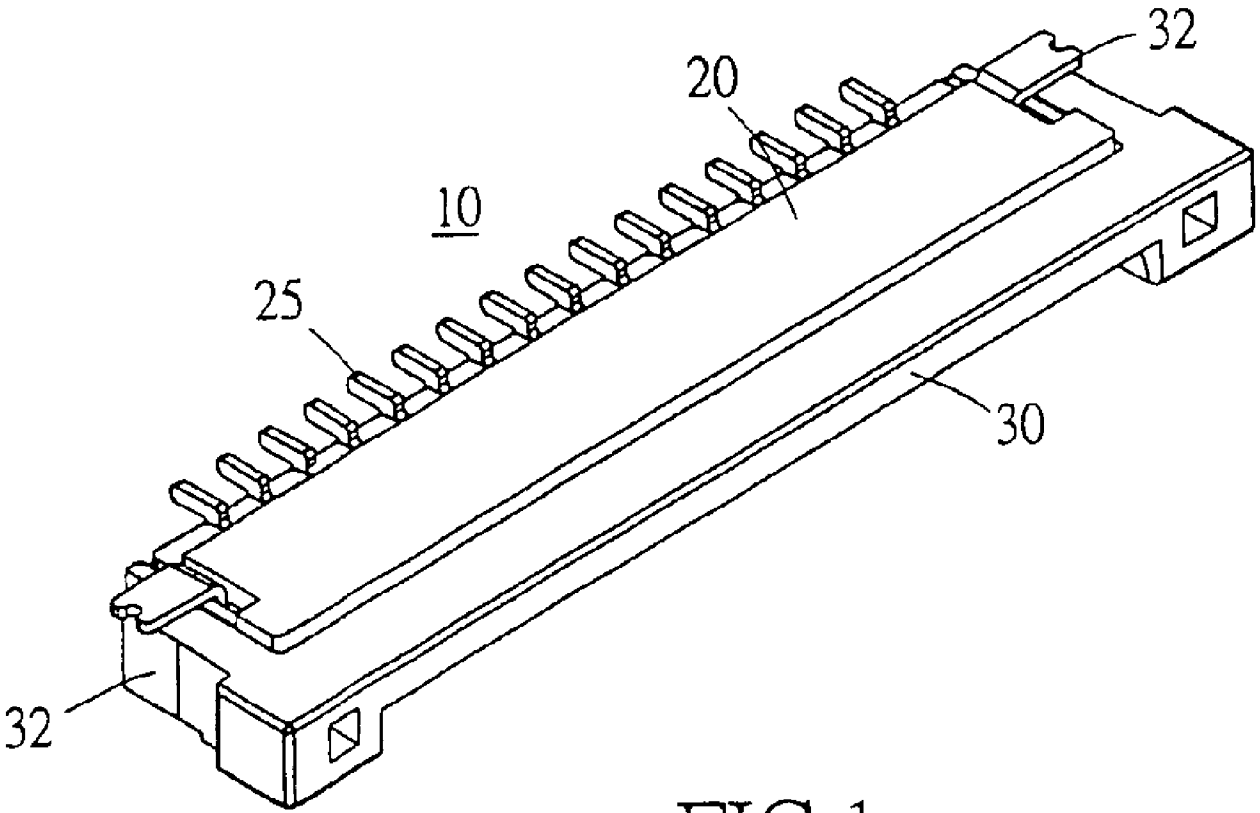
FIG.1 PRIOR ART
FIGS. 1 to 3 show conventional structural view and operating schematic views of a prior flexible circuit board connector.
Figure 2:
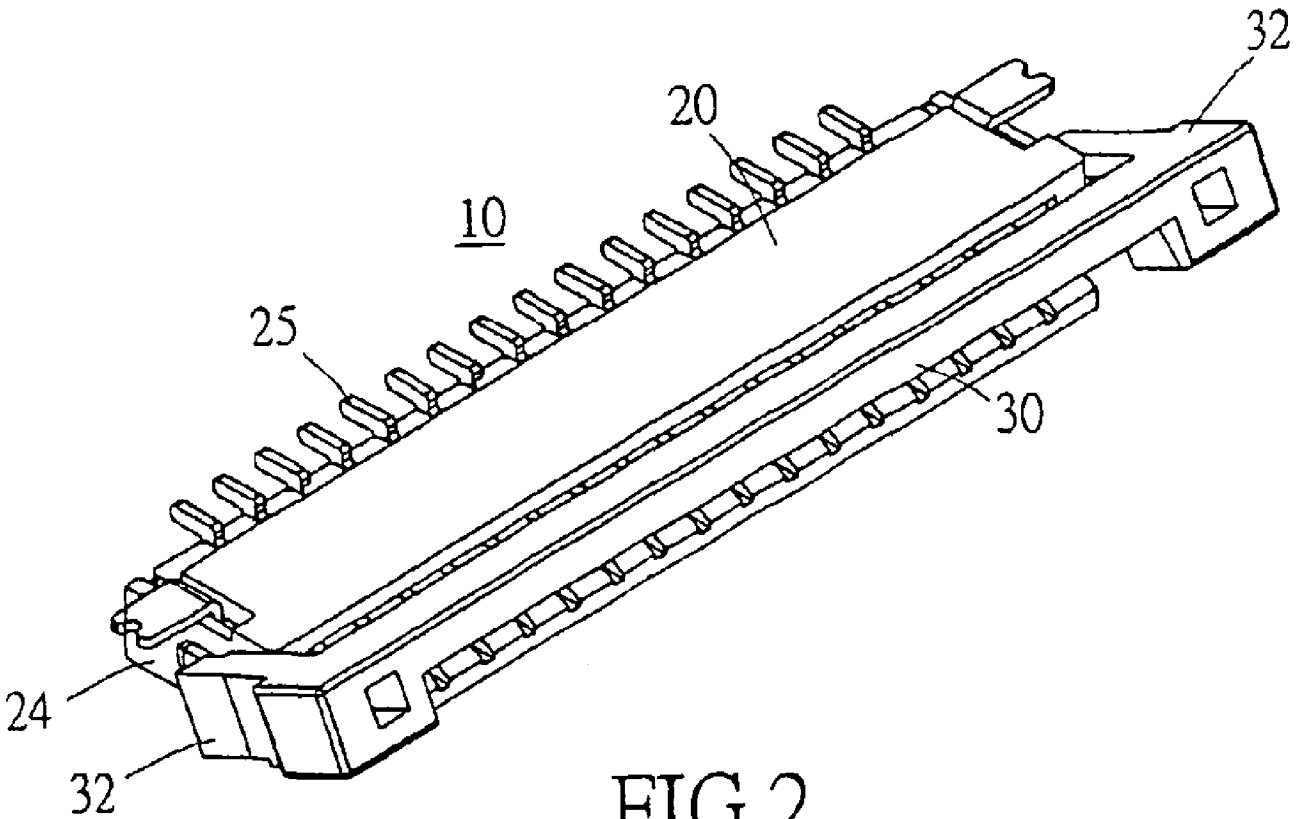
FIG.2 PRIOR ART
Figure 3:
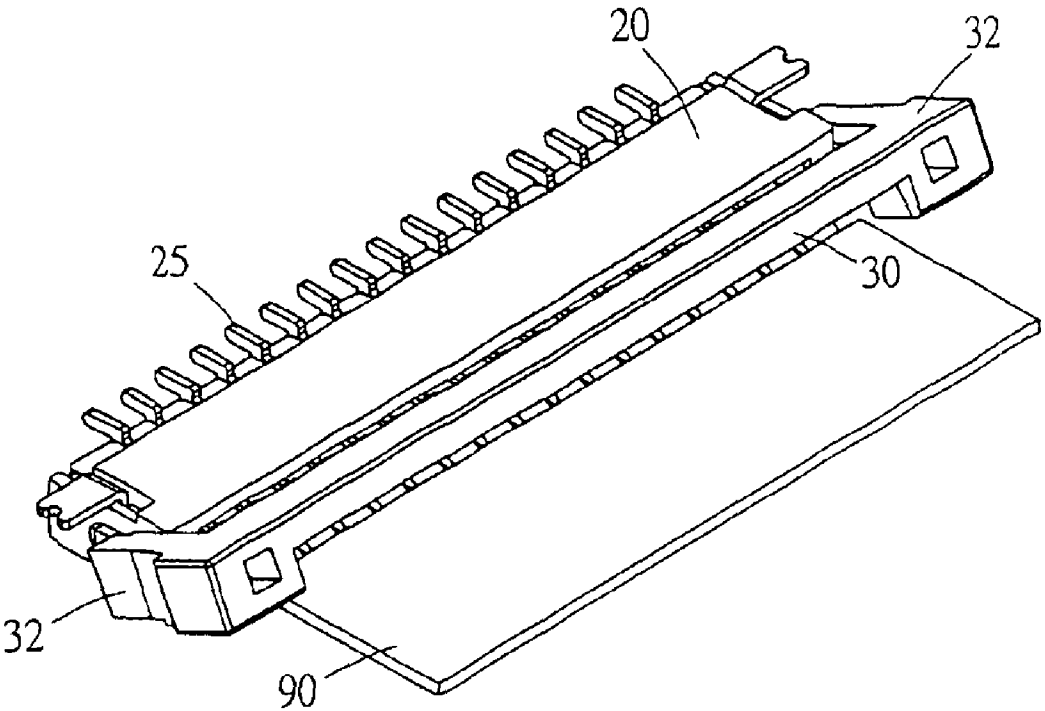
FIG.3 PRIOR ART

A width of the plate 61 of the movable lid 60 is narrower than that of the upper-tier open space at the base 51 of the concave body 50 but wider than that of the lower-tier open space, and the upper pin 71 of the terminal 70 is located at the upper-tier open space at the base 51 of the concave body 50. Therefore, referring to FIGS. 1 and 7, when the movable lid 60 is dosed, the movable lid 60 seals the upper-tier open space at the base 51 of the concave body 50 by leaning against top portions of the side flanges 52 of the base 51, and forms a cover of the concave body 50. In the meanwhile, the upper pin 71 of the terminal 70 is exposed in the terminal groove 64 at the movable lid 60, and thus completing an ultra-thin structure of the flexible circuit board connector 40.

Referring to FIGS. 7 to 10, to insert the flexible circuit board 90, the movable lid 60 of the flexible circuit board 90 is lifted to a maximum angle, so as to completely reveal the portal slot base 51 of the concave body 50 for facilitating insertion of the flexible circuit board 90. At this moment, the upper pin 71 of the terminal 70 is withdrawn from reactions of the protruding axis 65 of the movable lid 60, and the front portion of the upper pin 71 is no longer liable to be pressed downward. Therefore, the flexible circuit board 90 is smoothly entered along the side flanges 52 of the base 51 of the concave body 50, and is inserted into the inserting gap 75 of the terminal 70, thereby electrically connecting with the terminal 70. Next, the movable lid 60 becomes closed in the base 51 of the concave body. Then the protruding axis 65 of the movable lid 60 is acted upon the bent portion 74 of the upper pin 71 of the terminal 70, and the front portion of the upper pin 71 is pressed downward to lock the flexible circuit board 90. The flexible circuit board 90 becomes completely electrically connected with the terminal 70, and is not departed from the flexible circuit board connector 40 according to the invention when being used.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A flat flexible circuit board connector for connecting with a flexible circuit board comprising:

a) a concave body having:
   i) a base having a plurality of channels, each of the plurality of channels having an embedding rib having a front portion and a rear portion;
   ii) two side flanges located on opposing sides of the base; and
   iii) a receiving surface extending from a rear thereof;

b) a movable lid pivotally connected to a plurality of first terminals and movable between open and closed positions, the movable lid having:
   i) a board engaging the two side flanges when the lid is in the closed position; and
   ii) a plurality of terminal grooves; each of the plurality of terminal grooves having a protruding axis;

c) the plurality of first terminals, each of the plurality of first terminals having:
   i) an upper pin having a front portion and a rear portion;
   ii) a lower pin having a front portion and a rear portion;
   iii) an embedding pin connected to the rear portion of the lower pin;
   iv) an inserting gap located between the front portion of the upper pin and the front portion of the lower pin, the flexible circuit board is inserted into the inserting gap of each of the plurality of first terminals;
   v) a pivotal gap located between the rear portion of the upper pin and the rear portion of the lower pin, the protruding axis of one of the plurality of terminal grooves is inserted into the pivotal gap of each of the plurality of first terminals, wherein, when the movable lid is in the closed position, the protruding axis pressing against the rear portion of the upper pin of each of the plurality of first terminals and pressing the front portion of the upper pin of each of the plurality of first terminals against the flexible circuit board, and
   vi) a bottom gap located between the rear portion of the lower pin and the embedding pin, the rear portion of one of the plurality of channels of the concave body is inserted into the bottom gap of each of the plurality of first terminals; and d) a plurality of second terminals connected to the flexible circuit board, each of the plurality of second terminals having a gap into which the front portion of one of the plurality of channels of the concave body is inserted; wherein the rear portion of the upper pin of each of the plurality of first terminals includes a bent portion.

2. The flat flexible circuit board connector according to claim 1, wherein the embedding rib of each of the plurality of channels has a sunken recess located between the front portion and the rear portion.

3. The flat flexible circuit board connector according to claim 1, wherein the movable lid has a first blocking piece extending outwardly from a front thereof and second blocking pieces extending from opposing sides thereof.

4. The flat flexible circuit board connector according to claim 1, wherein the protruding axis of each of the plurality of terminal grooves has an ellipsoidal shaped cross section.

* * * * *